US011490718B2

(12) United States Patent
Lederle

(10) Patent No.: US 11,490,718 B2
(45) Date of Patent: Nov. 8, 2022

(54) CONCEALING HOLSTER SYSTEM

(71) Applicant: Matthew Eric Lederle, Denver, CO (US)

(72) Inventor: Matthew Eric Lederle, Denver, CO (US)

( * ) Notice: Subject to any disclaimer, the term of this patent is extended or adjusted under 35 U.S.C. 154(b) by 160 days.

(21) Appl. No.: 17/151,508

(22) Filed: Jan. 18, 2021

(65) Prior Publication Data

US 2021/0219708 A1 Jul. 22, 2021

Related U.S. Application Data

(60) Provisional application No. 62/961,861, filed on Jan. 16, 2020.

(51) Int. Cl.
*A45F 5/00* (2006.01)
*F41C 33/04* (2006.01)

(52) U.S. Cl.
CPC ..... *A45F 5/00* (2013.01); *A45F 2200/0575* (2013.01); *A45F 2200/0591* (2013.01); *F41C 33/048* (2013.01)

(58) Field of Classification Search
CPC ..... A45F 2200/0575; A45F 2200/0591; F41C 33/048; F41C 33/0209; F41C 33/041; A45C 13/02; A45C 2013/026
USPC ..... 224/587
See application file for complete search history.

(56) References Cited

U.S. PATENT DOCUMENTS

| | | | | |
|---|---|---|---|---|
| 981,292 | A | 1/1911 | Lewis | |
| 3,630,420 | A * | 12/1971 | Bianchi | F41C 33/0227 224/193 |
| 3,797,715 | A | 3/1974 | Scialdone | |
| 3,977,583 | A * | 8/1976 | Bianchi | F41C 33/0227 29/446 |
| 4,212,418 | A | 7/1980 | Bianchi | |
| 4,303,185 | A * | 12/1981 | Shoemaker | F41C 33/0227 224/193 |
| 4,750,652 | A | 6/1988 | Grant | |
| 4,903,874 | A | 2/1990 | Shoemaker | |
| 5,358,160 | A | 10/1994 | Bianchi | |
| 5,671,539 | A | 9/1997 | Barone | |
| 7,380,692 | B2 * | 6/2008 | Kostal | F41C 33/041 224/269 |
| D658,364 | S | 5/2012 | Davis et al. | |
| D746,586 | S | 1/2016 | Tusting | |
| 9,315,301 | B1 * | 4/2016 | Martinez | A45C 11/20 |
| 9,451,820 | B2 * | 9/2016 | Lukin | B65D 51/00 |
| 2006/0226185 | A1 * | 10/2006 | Har-Shen | F41C 33/0209 224/244 |
| 2011/0093996 | A1 | 4/2011 | Henriquez | |
| 2015/0027025 | A1 * | 1/2015 | Mantua | F41C 33/0236 42/90 |

(Continued)

*Primary Examiner* — Adam J Waggenspack

(57) ABSTRACT

A system for supporting an article in a concealed state includes a holster shell, a holster insert and a first perforated strap. The holster shell has a holster cavity surrounded by an upper edge and, opening the cavity to surroundings, opposing slots extending into the upper edge. The holster insert is configured for receipt within the holster cavity and includes opposing eyelets configured for receipt within the opposing slots of the holster shell. The first perforated strap has a visible light transmittance of at least 10% as well as first and second ends configured for selective coupling with the opposing eyelets of the holster insert.

20 Claims, 10 Drawing Sheets

(56) References Cited

U.S. PATENT DOCUMENTS

| | | | | |
|---|---|---|---|---|
| 2015/0158172 | A1* | 6/2015 | Conway | B25H 3/02<br>206/349 |
| 2019/0137217 | A9 | 5/2019 | Wasylko | |
| 2019/0219357 | A1 | 7/2019 | Ryckman | |

* cited by examiner

CONCEALING HOLSTER SYSTEM

CROSS-REFERENCE TO RELATED APPLICATIONS

This application claims the priority benefit of U.S. Provisional Application No. 62/961,861, pending, filed on Jan. 16, 2020 which is incorporated herein by reference in its entirety.

BACKGROUND

Adequately concealing a weapon is difficult to impossible for people that wear business attire and especially those who have lean and/or athletic builds primarily because contemporary professional clothing is cut athletically with tapering in shirts, blouses, slacks, skirts and dresses leaving little room for concealing a weapon comfortably. Further, those who prefer not to wear undershirts yet prefer to wear shoulder holsters have few, if any, options.

SUMMARY

The disclosure describes an embodiment of a system for supporting an article in a concealed state. The system includes a holster shell, a holster insert and a first perforated strap. The holster shell surrounds a holster cavity bounded in part by an upper perimeter having at least first and second opposing edges and defines first and second slots opening the cavity to surroundings. The holster insert is configured for receipt within the holster cavity and includes first and second eyelets configured for engaging the first and second slots of the holster shell. The first perforated strap has a visible light transmittance of at least 10% as well as first and second ends configured for threading through the opposing eyelets of the holster insert.

Another embodiment of the system described by the disclosure also includes a holster shell, a holster insert and a first perforated strap. The holster shell surrounds a holster cavity bounded in part by an upper perimeter having at least first and second opposing edges and defines first and second slots opening the cavity to surroundings. The holster insert is configured for receipt within the holster cavity and includes first and second eyelets configured for engaging the first and second slots of the holster shell. The first perforated strap has first and second ends configured for threading through the opposing eyelets of the holster insert and, extending between the first and second ends, first and second long edges which follow sinusoidal paths.

Yet another embodiment of the system described by the disclosure includes a holster shell, a holster insert and a cap. The holster shell includes a holster cavity bounded in part by an upper perimeter and having an internal positive retention feature distal from the upper perimeter. The holster insert is configured for receipt within the holster cavity and includes a through-hole configured for engagement with the positive retention feature to selectively lock the holster insert within the holster cavity. The cap is configured to surround the holster cavity adjacent to the upper perimeter and includes a split in a top of the cap configured for flexing between a closed position retaining an article within the holster insert and an open position releasing an article within the holster insert.

BRIEF DESCRIPTION OF THE FIGURES

The summary above, as well as the following detailed description of illustrative embodiments, is better understood when read in conjunction with the appended drawings. For the purpose of illustrating the disclosure, example configurations are shown in the drawings. However, the disclosure is not limited to specific methods and instrumentalities disclosed herein. Moreover, those having ordinary skill in the art will understand that the drawings are not necessarily to scale. Wherever possible, like elements have been indicated by identical numbers.

Embodiments of the disclosure will now be described, by way of example only, with reference to the following diagrams wherein.

DETAILED DESCRIPTION

Figure 1:
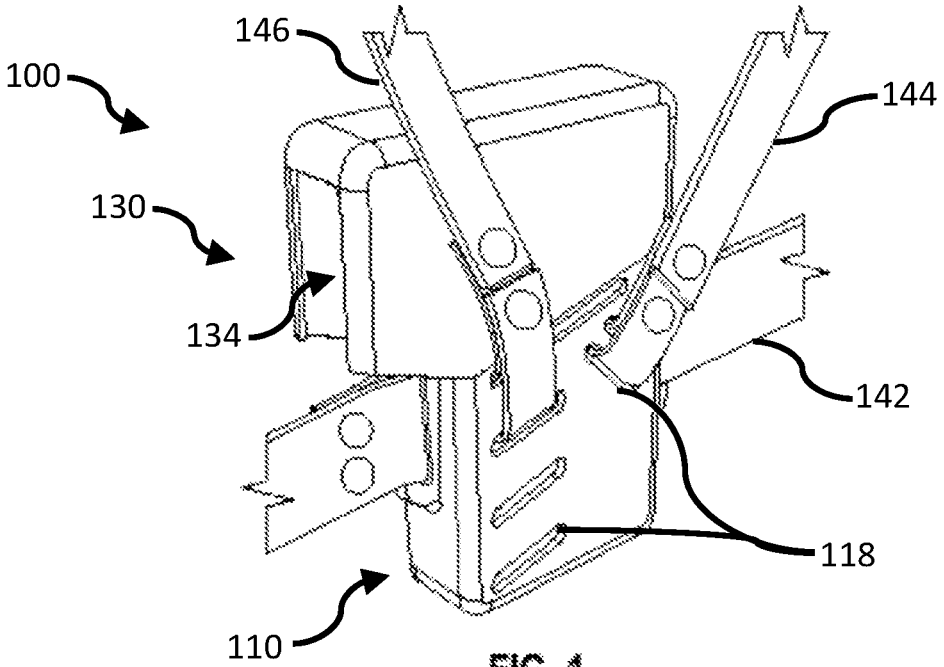
FIG. 1 illustrates a perspective view of an example concealing holster.
Figure 2:
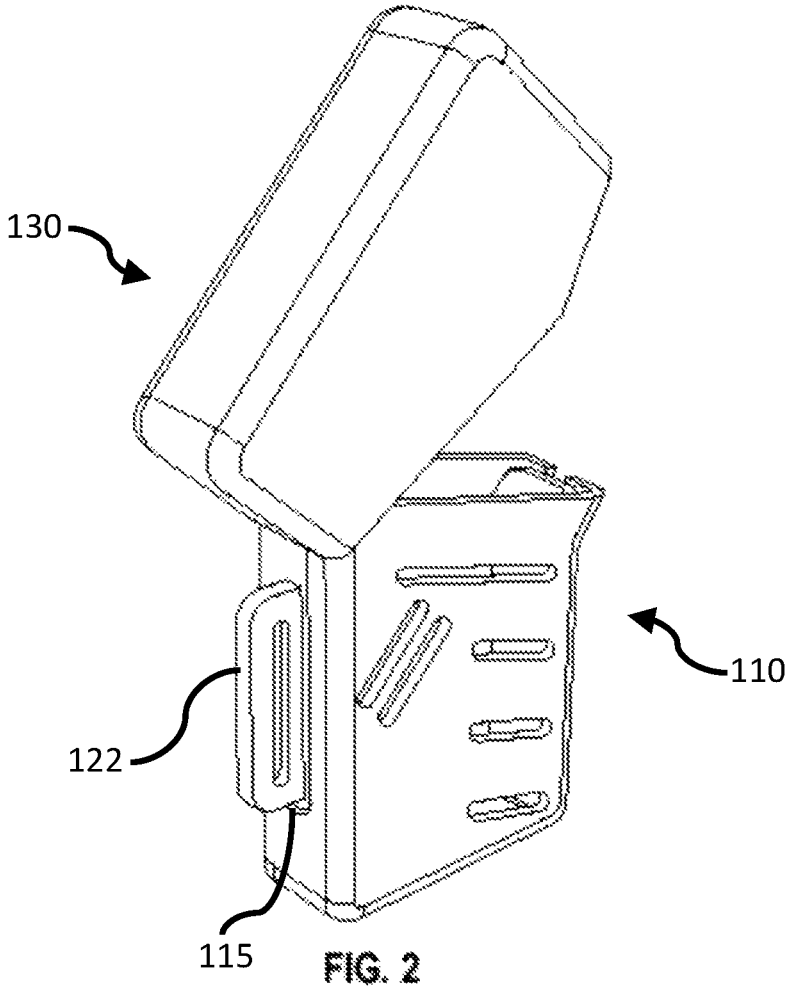
FIG. 2 illustrates a perspective view of the example concealing holster of FIG. 1 with a lid in an open position.
Figure 3:
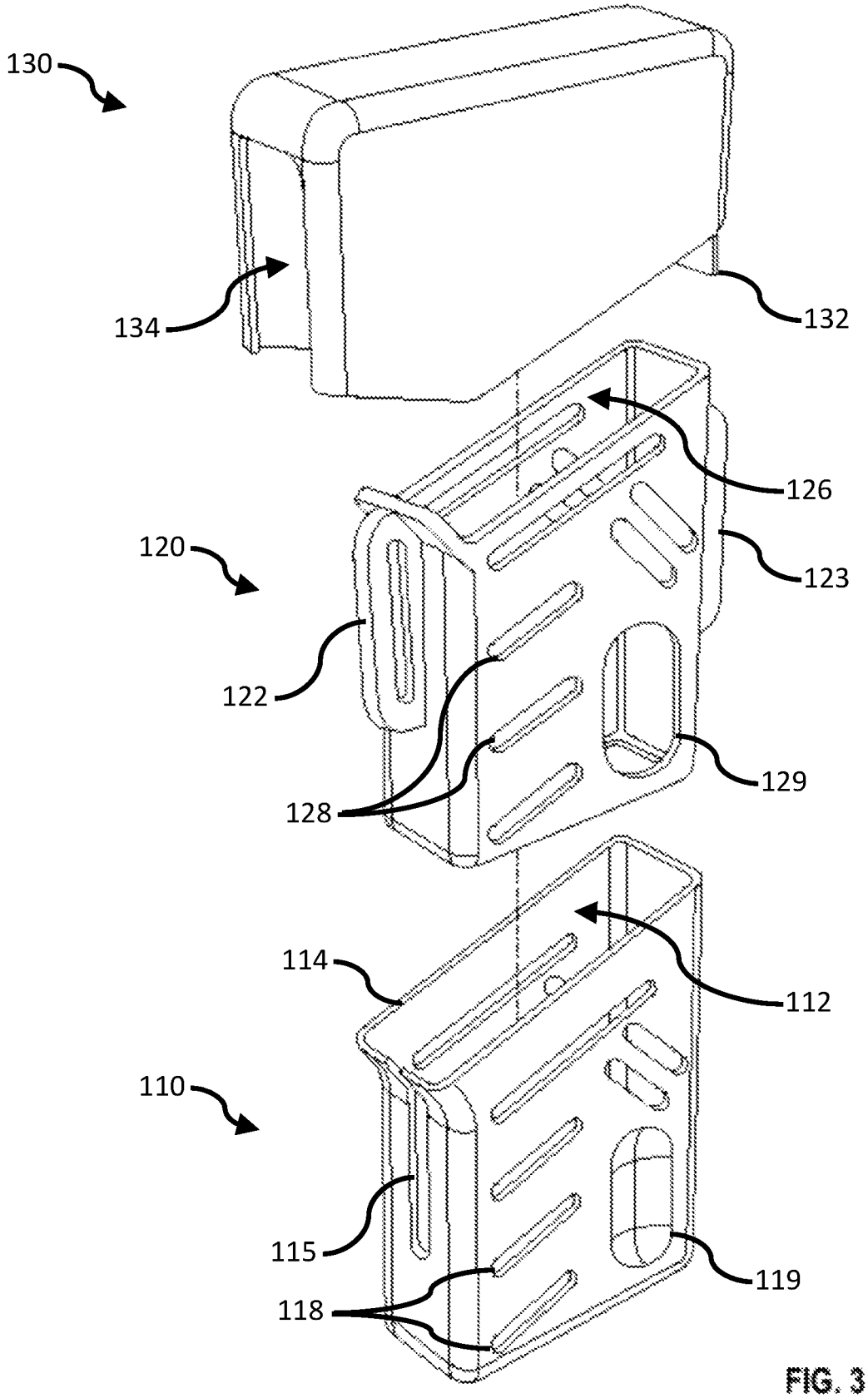
FIG. 3 illustrates an exploded view of the example concealing holster of FIGS. 1 & 2.
Figure 4:
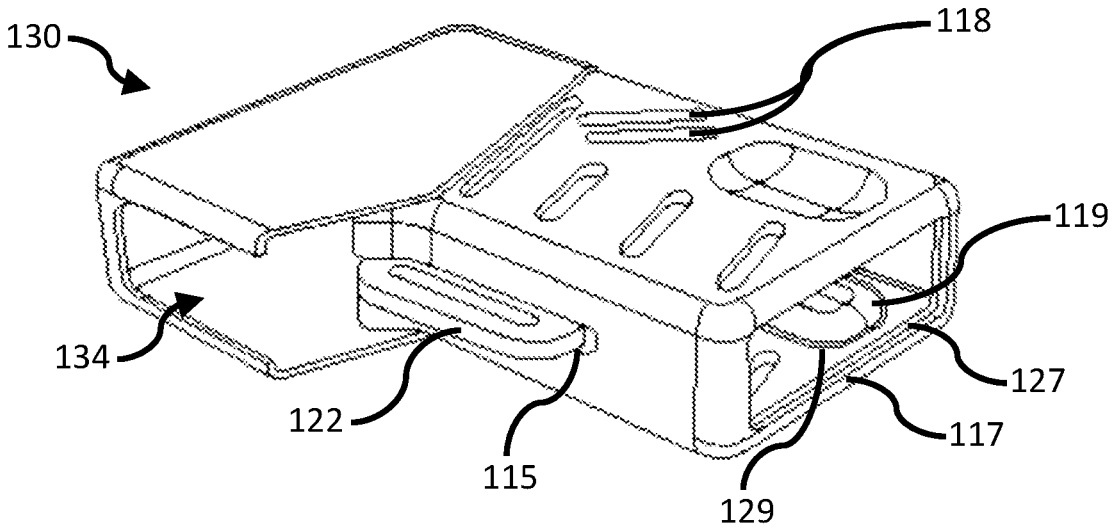
FIG. 4 illustrates a bottom perspective view of the example concealing holster of FIGS. 1-3.
Figure 5:
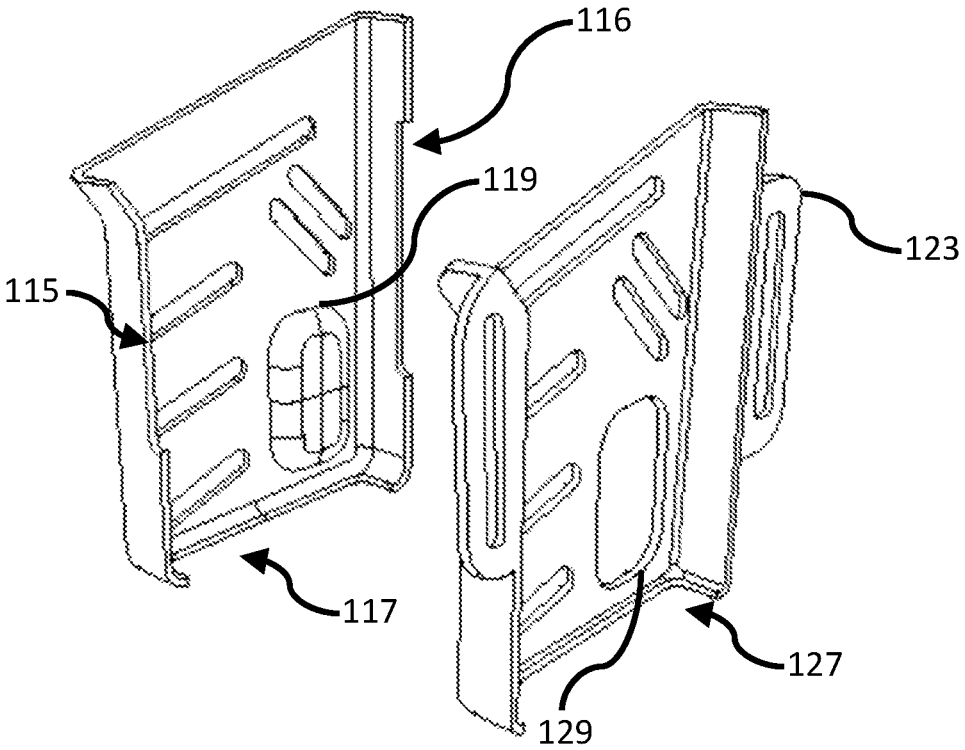
FIG. 5 illustrates a detail view of the concealing holster of FIGS. 1-4.

The following detailed description illustrates embodiments of the disclosure and manners by which they can be implemented. Although the particular modes of carrying out disclosed systems, apparatuses and methods has been described, those of ordinary skill in the art would recognize that other embodiments for carrying out or practicing disclosed systems, apparatuses and/or methods are also possible.

It should be noted that the terms "first", "second", and the like, herein do not denote any order, quantity, or importance, but rather are used to distinguish one element from another. Further, the terms "a" and "an" herein do not denote a limitation of quantity, but rather denote the presence of at least one of the referenced item. Further still, directions such as "up" and "down" and "upper" and "lower" are used relative to one another and not intended to encompass any universal direction.

Even a white fabric shoulder holster worn against the skin, under a white shirt, shows prominently through the fabric, in fact any color of material does so. Embodiments of the disclosure substantially eliminate, or at least partially address, problems in the prior art, enabling a virtually undetectable concealed-carry shoulder holster.

Embodiments of the disclosure provide a system for supporting an article in a concealed state which may take the form of a concealing holster. Embodiments further provide a method for supporting an article in a concealed state. Additional aspects, advantages, features and objects of the disclosure will be made apparent from the drawings and the detailed description of the illustrative embodiments construed in conjunction with the appended claims that follow.

It will be appreciated that described features are susceptible to being combined in various combinations without departing from the scope of the disclosure as defined by the appended claims.

FIGS. 1-5 illustrate various views of an example concealing holster system which enables supporting an article in a concealed state. System 100 includes a holster shell 110, a holster insert 120 and may include a topper 130 or 230 and a group of perforated straps.

The holster shell 110 has a pocket or open holster cavity 112 (FIGS. 2-3) bounded in part by an upper perimeter 114 having at least first and second opposing edges and first and second slots 115 and 116 opening the cavity 112 to surroundings. The first slot 115 extends into the first opposing edge passing through the internal surface of the holster cavity 112 and the external surface of the holster shell 110. The second slot 116 is positioned below the second opposing edge (FIG. 2) and passes through both the internal surface of the holster cavity 112 and the external surface of the holster shell 110. The first and second edges may define the upper extent of the holster cavity 112 as well as the upper extent of left and right sides of the holster shell 110. Front and back sides of the holster shell 110 may be defined between the left and right sides and extend to upper edges at the upper perimeter 114. Holster shell 110 may take any of a variety of forms. For example, holster shell 110 may generally take the form of a rectangular prism truncated along an oblique angle, may be domed or may be rounded.

Pass-throughs 118 of the holster shell 110 provide attachment points for one or more tethers including but not limited to straps 142, 144 and/or 146, belts, hooks and anchors. For example, straps 142 and 146 may be threaded or woven through one or more of pass-throughs 118. While any number of pass-throughs may be provided as attachment points, in an example, six pass-throughs are provided to each of the front and back sides of the holster shell 110.

The holster insert 120 is configured for receipt within the holster cavity 112 and includes opposing eyelets configured for receipt within the opposing slots 115 and 116 of the holster shell 110. The holster insert 120 also includes a cavity 126 configured to receive, carry and/or house an article such as a tool or firearm.

Pass-throughs 128 of the holster insert 120 similarly provide attachment points for one or more tethers including but not limited to straps 142, 144 and/or 146, belts, hooks and anchors. For example, straps 142 and 146 may be threaded or woven through one or more of pass-throughs 128. While any number of pass-throughs may be provided as attachment points, in an example, six pass-throughs are provided to each of the front and back sides of the holster insert 120.

Pass-throughs 128 of the holster insert 120 may align with pass-throughs 118 of the holster shell 110 to enable one or tethers or hooks to be threaded therethrough to tether or suspend disclosed concealing holsters to a user or support.

The holster shell 110 further includes, opposite the upper perimeter 114, a lower perimeter bounding a through-hole 117 and the holster insert 120 further includes a through-hole 127 (FIG. 4) configured to align with the through-hole 117 of the holster shell 110 with the holster insert 120 received therein. In use, a part of a tool or a barrel and or muzzle of a firearm may protrude from the aligned through-holes 117 and 127.

The holster insert 120 may further include a sidewall through-hole 129 and the holster shell 110 may further include a sidewall boss or similar positive retention feature 129 within the cavity 112 configured for receipt within the sidewall through-hole 129 of the holster insert 120. Engagement of the boss 119 and the sidewall through-hole 129 causes the holster insert 120 to be selectively locked into the cavity 112 of the holster shell 110. Materials of the holster shell 110 and/or the holster insert 120 allow for the boss 119, the through-hole 129 or both to flex and deform into and out of the positions needed to insert the boss 119. At the exterior surface of holster shell 110, boss 119 may form a pocket or may be flat and continuous with the rest of the exterior surface.

The system 100 may further include a topper configured for coupling with the holster shell 110 and/or the holster insert 120 so as to extend away from the upper edge of the holster shell 110 in a direction opposite the opposing slots 115 and 116 and to close an end of the holster cavity 112

In an example, the topper takes the form of a lid 130 configured for hinged coupling with the holster insert 120 and/or holster shell 110. Hinge 132 may be selectively coupled with the holster insert 120, for example, between an upper edge of the holster insert cavity 126 and eyelet 123.

Figure 6:
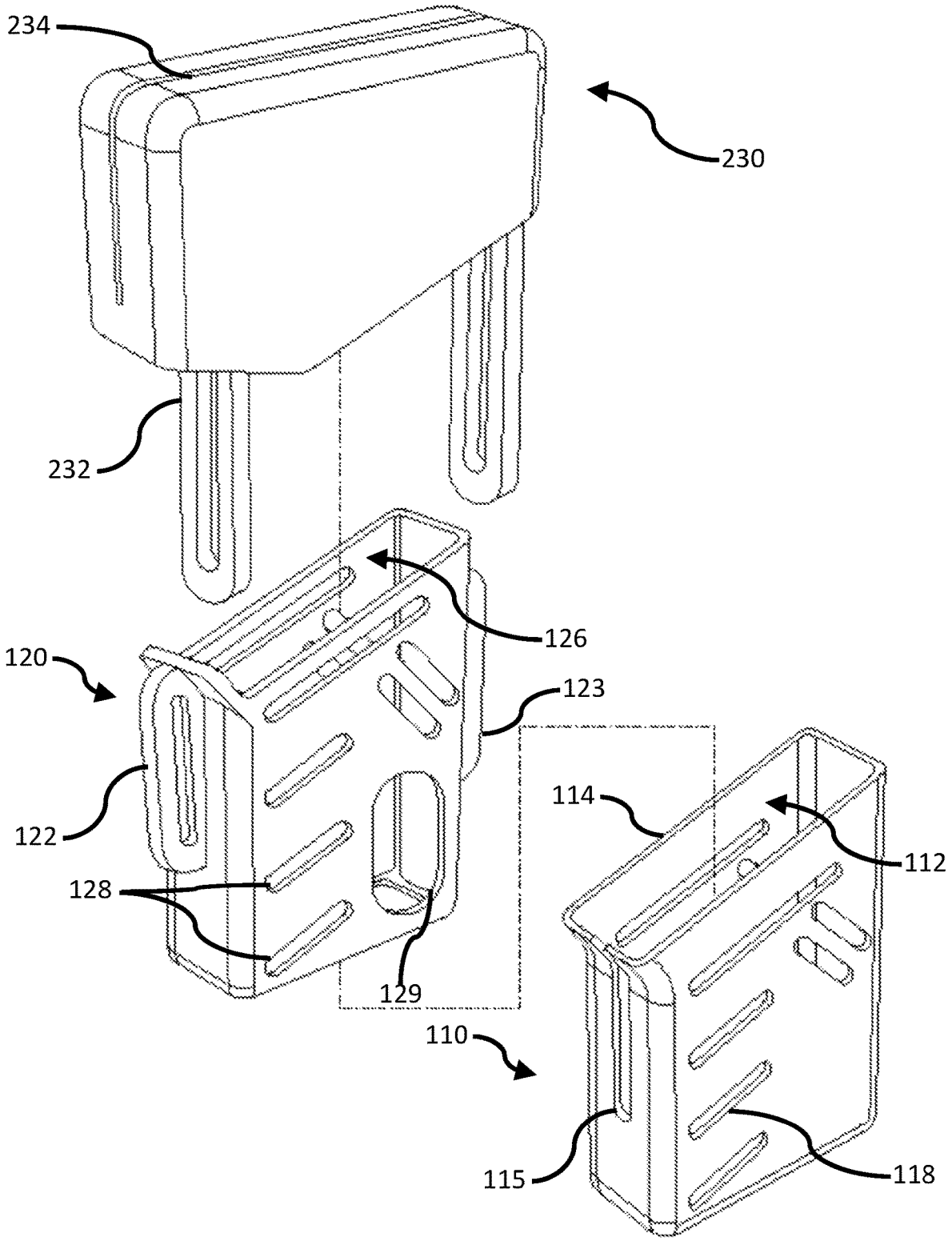
FIG. 6 illustrates an exploded view of another example concealing holster.
Figure 7:
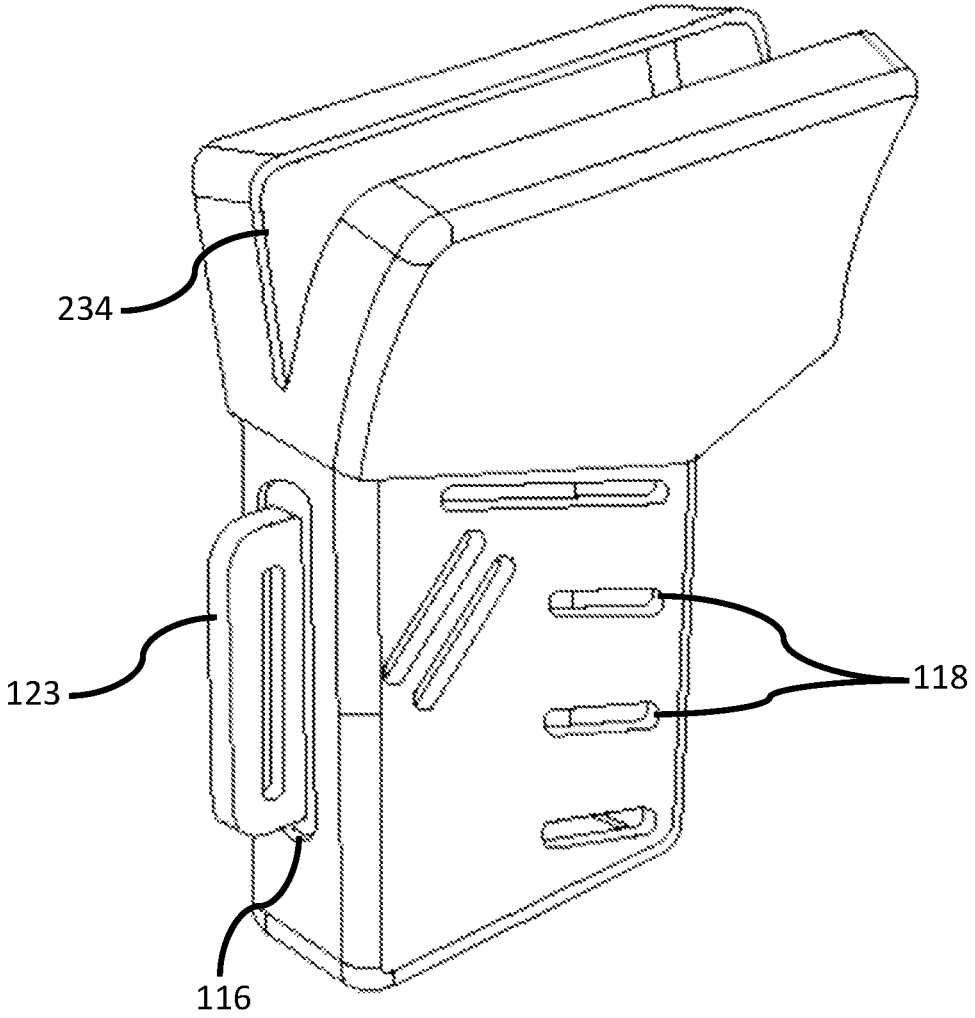
FIG. 7 illustrates a perspective view of the example concealing holster of FIG. 6 with a cap in an open position.

In another example, the topper may take the form of a cap 230 (FIGS. 6-7) configured to similarly surround the holster cavity 112 adjacent to the upper perimeter to close the upper end of the holster cavity 112. The cap 230 includes a one or more retention loops 232 and a split 234 in a top of the cap 230 distal from the retention loops 232. Each of the retention loops 232 is configured to surround and grip the opposing eyelets 122 and 123 of the holster insert 120. The split 234 is configured for flexing between a closed position (FIG. 4) for retaining an article within the holster insert 120 and an open position (FIG. 5) for releasing an article within the holster insert 120. Materials suitable for cap 230 are sufficiently flexible to enable easy opening of split 234 with a user's fingers.

The holster shell 110, holster insert 120, lid 130 and cap 230 may be formed from any of a variety of breathable, translucent to transparent materials, with low risk for any chemical absorption through the skin of the user. Holster shell 110 may be formed from a lower durometer material while the insert is formed from a higher durometer material.

Example materials for holster shell 110 exhibit Shore A durometer of from about 40 to about 60 while example materials for holster insert 120 exhibit Shore A durometer of about 50. Example materials include but are not limited to heat-curable or cold-curable elastomers, and/or medical-grade rubber materials such as silicone, TPE, polyurethane and/or TPU.

Figure 10:
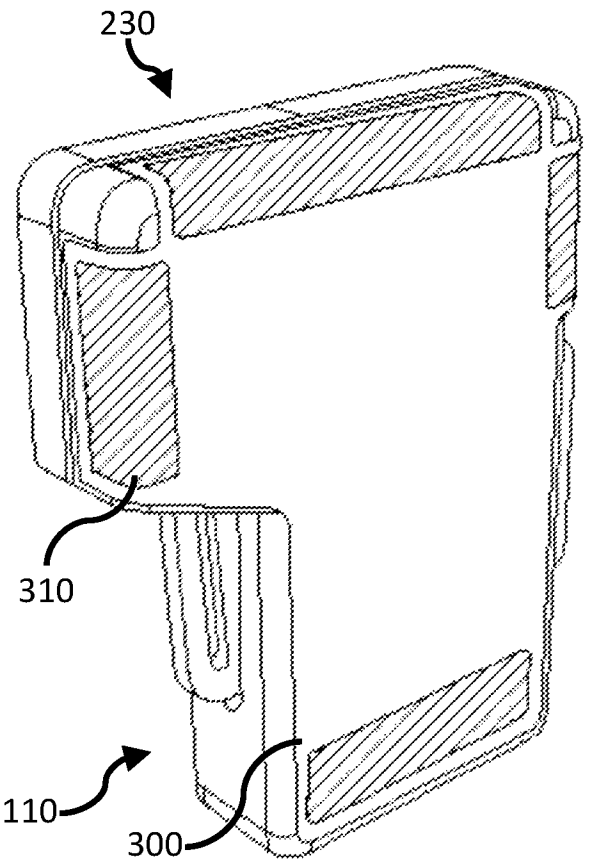
FIG. 10 illustrates a perspective view of the example concealing cloak of FIG. 9 coupled with an example concealing holster.
Figure 9:
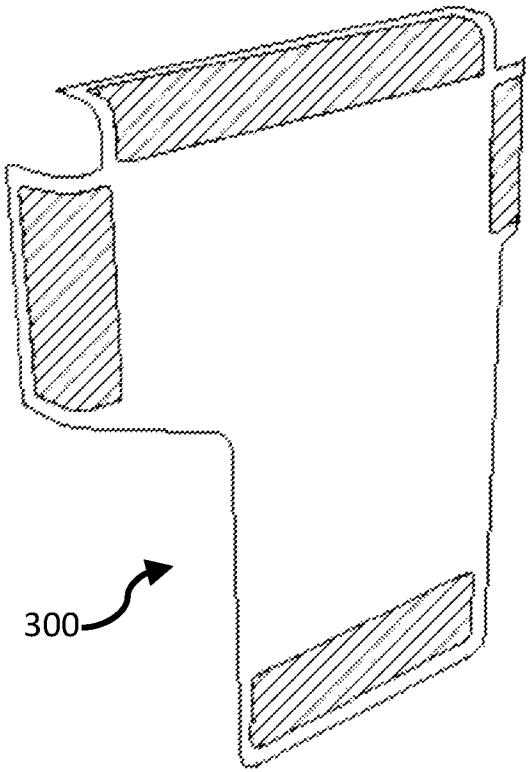
FIG. 9 illustrates a perspective view of an example concealing cloak suitable for use in association with disclosed concealing holsters.
Figure 8:
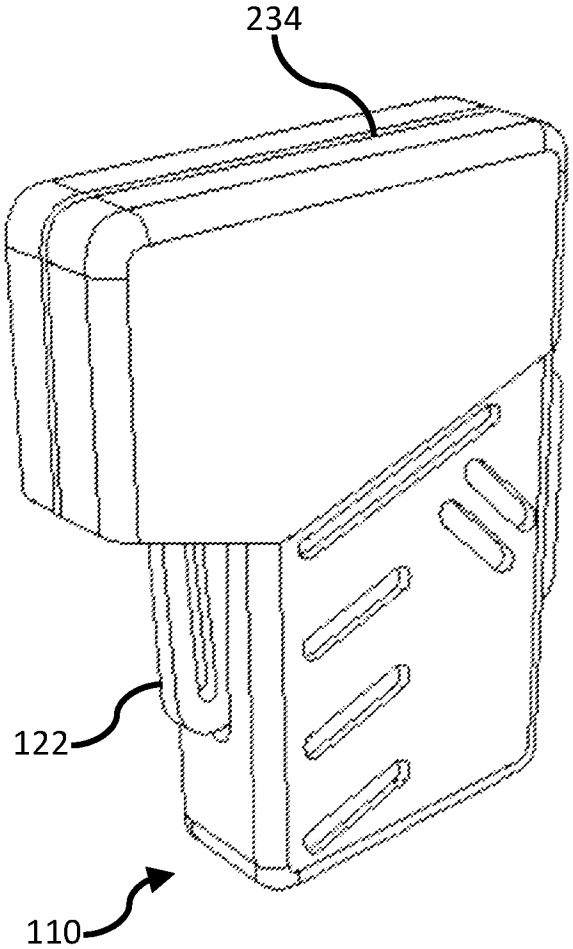
FIG. 8 illustrates another perspective view of the concealing holster of FIGS. 6 &7.

Referring to FIGS. 8-10, system 100 further includes several concealing cloaks 300 each matching a silhouette of an assembly of the holster shell 110, holster insert 120 and topper 130 or 230. Each of concealing cloaks include one or more of several colors configured for matching with a skin tone of a user. Concealing cloaks 300 grip the holster shell 110 by means 310 such as adhesive, hook and loop fasteners, buttons or magnets.

Figure 12:
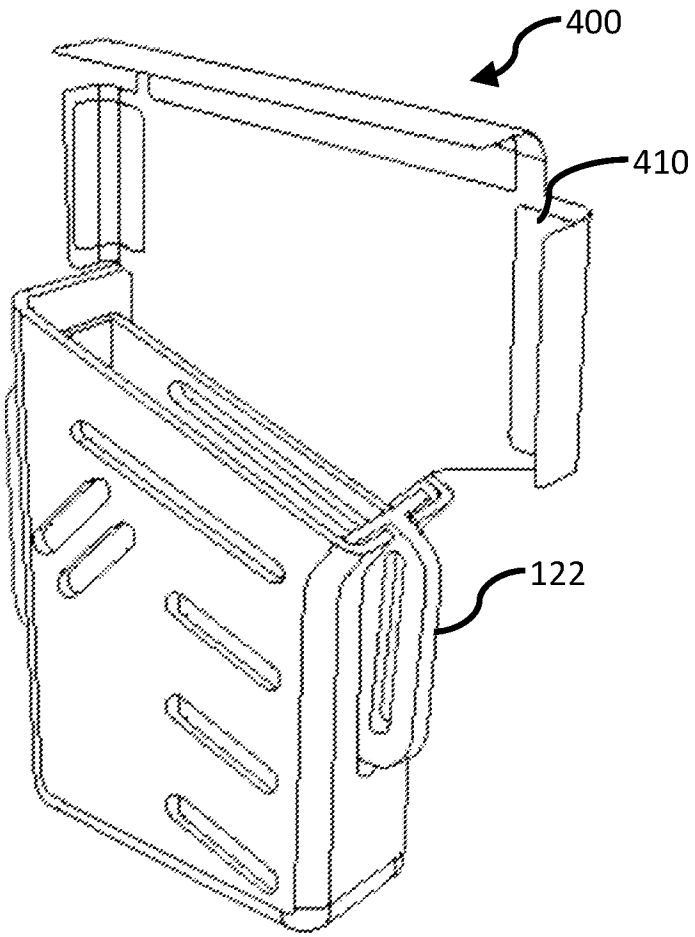
FIG. 12 illustrates another perspective view of the example concealing sleeve of FIG. 11 coupled with an example concealing holster.
Figure 11:
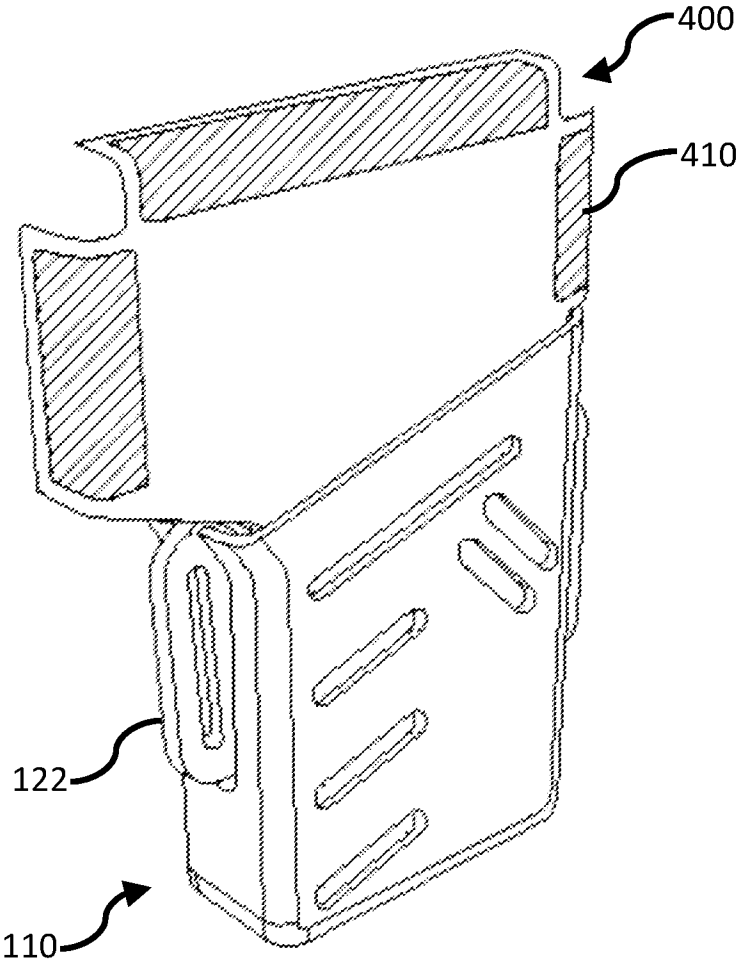
FIG. 11 illustrates a perspective view of an example concealing sleeve coupled with an example concealing holster.

Referring to FIGS. 11 & 12, system 100 may further include several concealing sleeves 400 each configured for receipt between an interior surface of the holster cavity 112 and an exterior surface of the holster insert 120. As with concealing cloaks 300, each of the concealing sleeves 400 include one or more of a plurality of colors configured for matching with a skin tone of a user. Similarly, concealing sleeves 400 grip the holster shell 110 with means 410 such as adhesive, hook and loop fasteners, buttons or magnets.

Figure 13:
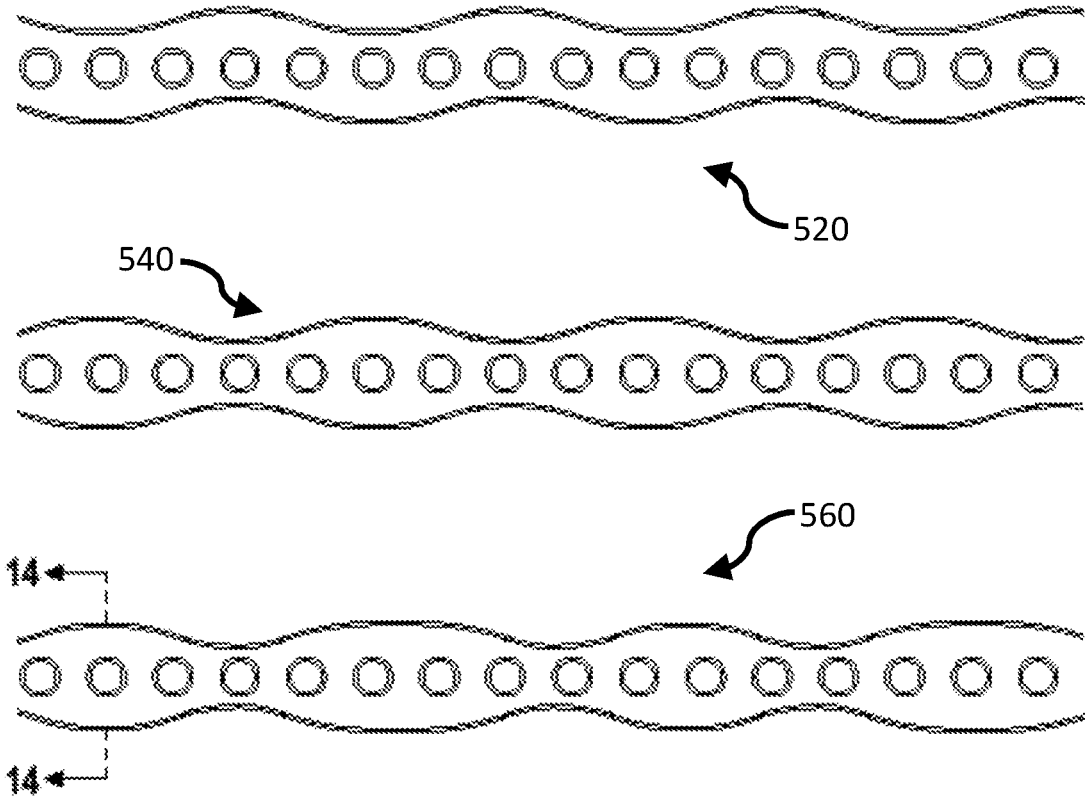
FIG. 13 illustrates example sinusoidal edge paths of example straps suitable for use in association with disclosed concealing holsters.

Referring to FIG. 13, disclosed straps include perforated straps. Perforations of the straps may take any of a variety of configurations including but not limited to aligned along a straight path. In an example, the perforations may be arranged in two rows which may be aligned along straight, parallel paths.

While perforations pass light therethrough unobstructed, the material of the strap between the perforations also has an opacity from translucent to transparent or is at least translucent. For example, the straps may have a visible light transmittance of at least 10% and/or include a material produced so as to have a visible light transmittance of at least 10%. In another example, the straps may have a visible light transmittance of more than 40% and/or include a material produced so as to have a visible light transmittance of more than 40%. With this characteristic, a variety of skin colors and/or toness how through, making the straps substantially or practically invisible even through a white shirt and irrespective of the environment of the user or wearer. As such, the straps are effectively invisible whether the user is outdoors on a sunny day, or in an indoor, well-lit environment such as office buildings/conference rooms, etc.

The straps may be formed from any of a variety of breathable, translucent to transparent materials, with low risk for any chemical absorption through the skin of the user. In an example, the material exhibits Shore A durometer of from about 40 to about 60 and has a thickness of from about 1/32" to about 1/4". Example materials include but are not limited to heat-curable or cold-curable elastomers and/or medical-grade rubber materials such as silicone, TPE, polyurethane and/or TPU.

Each strap includes first and second ends configured for selective threading or weaving through the opposing eyelets of the holster insert 120, pass-throughs 118 of the holster insert 120 and/or holster shell 110, or with each other. The perforations of the straps follow one or more paths extending generally between the first and second ends thereof. First and second long edges extend between the first and second ends of each strap. The first and second long edges may follow serpentine or sinusoidal or otherwise wave-like paths to reduce imprinting or patterning through articles of clothing worn over the straps contributing further to concealing of system 100 and enabling undetectable carrying of an article.

By way of example, disclosed straps may take the form of strap 520 which includes edges following offset wave-like paths. The crests of the first long edge path are aligned with the crests of the second long edge path while the troughs of the first long edge path are aligned with the troughs of the second long edge path.

In another example, disclosed straps may take the form of strap 540 which includes edges following symmetric wave-like paths. The crests of the first long edge path are aligned with the troughs of the second long edge path while troughs of the first long edge path are aligned with crests of the second long edge path.

In another example, disclosed straps may take the form of strap 560 which includes edges following alternating symmetric wave-like paths. Wavelengths of the wave-like paths of each of the first and second long edges are variable and/or alternate among a plurality of wavelengths.

Figure 14:
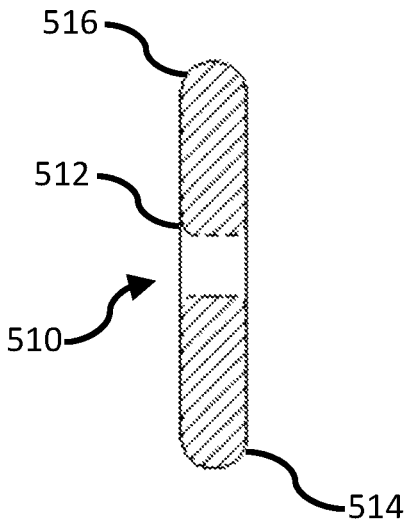
FIG. 14 illustrates a cross-section of an example strap suitable for use in association with disclosed concealing holsters.

As may be best appreciated from FIG. 14, in order to still further reduce the profile of the straps, edges such as long edges 514 and 516 may be beveled or rounded. Still further, the perforations 510 of the straps may also include beveled or rounded edges 512.

Straps of system 100 may be used as torso/waist strap 142, first shoulder strap 144 and/or second shoulder strap 146 but are not limited to these uses. First and second ends of a strap used as torso strap 142 may be threaded through eyelets 122 and 123 and folded back onto the strap with perforations aligned so that a fastener may be inserted through aligned perforations to selectively secure the strap to itself.

A first end of a strap used as a shoulder strap 144 or 146 may be threaded through pass-throughs 118 and/or 128 and folded back onto the strap with perforations aligned so that a fastener may be inserted through aligned perforations to selectively secure the strap to itself. Perforations near a second end of a strap used as a shoulder strap 144 or 146 may be aligned with perforations of a torso strap so that a fastener may be inserted through aligned perforations to selectively secure the shoulder strap to the torso strap.

The system 100 may further include a neck strap or yoke strap having first and second ends and, intermediate the first and second ends, a neck opening surrounded by first and second shoulder segments. The first end of the yoke strap may be configured for coupling with a torso strap and the second end of the yoke strap may be configured for coupling with the torso strap strap generally diametrically opposite to the first end.

Disclosed fasteners are configured to pin or rivet portions of a single strap together by insertion into respective perforations and/or pin or rivet one or more portions of a first strap with one or more portions of a second strap. The fasteners may similarly be formed from any of a variety of breathable, translucent to transparent materials, with low risk for any chemical absorption through the skin of the user. In an example, the material exhibits Shore A durometer of about 20 to about 80. Example materials include but are not limited to heat-curable or cold-curable elastomers, and/or medical-grade rubber materials such as silicone, TPE, polyurethane, and/or TPU.

The system 100 may further include a thumb strap configured for selective coupling with the holster shell 110 to hold an article in the holster insert 120 during inversion or jostling.

Figure 15:
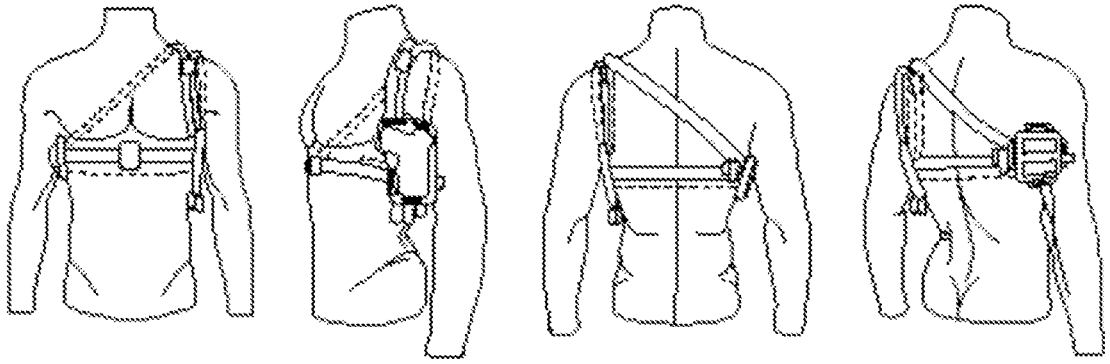
FIG. 15 illustrates an example wearable configuration of disclosed concealing holsters.

FIG. 15 illustrates an example wearable configuration of disclosed concealing holsters. A first strap coupled with the holster shell 110 and holster insert 120, for example, through eyelets 122 and 123, encircles a user's torso. A first shoulder strap loops over a first shoulder between first and second ends coupled to the holster shell 110 and/or insert 120 or the torso strap. A second shoulder strap loops from the holster shell 110 and/or insert 120 or the torso strap near the first end of the first shoulder strap over the first shoulder and behind the back to a point on the torso strap generally diametrically opposite to the first end of the second shoulder strap.

Figure 16:
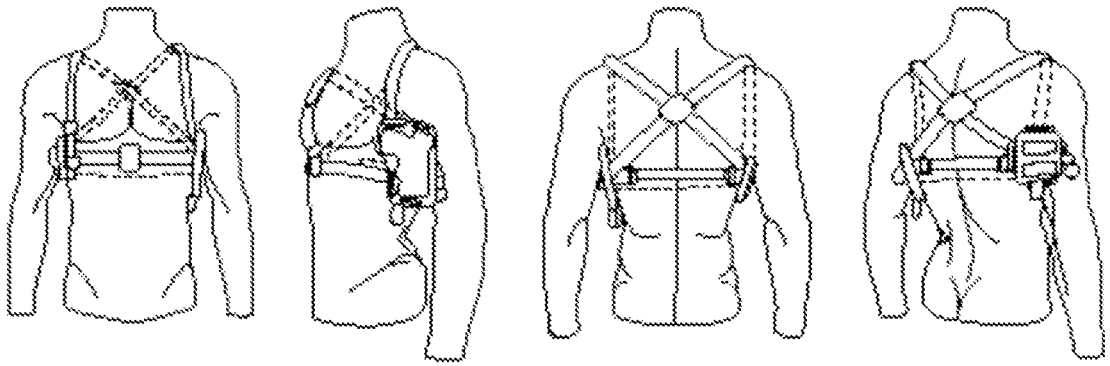
FIG. 16 illustrates another example wearable configuration of disclosed concealing holsters.

FIG. 16 illustrates another example wearable configuration of disclosed concealing holsters. A first strap coupled with the holster shell 110 and holster insert 120, for example, through eyelets 122 and 123, encircles a user's torso. A first shoulder strap loops from the holster shell 110 and/or insert 120 over a first shoulder and behind the back to a point on the torso strap under a second shoulder and generally diametrically opposite to the first end of the first shoulder strap. A second shoulder strap loops from the holster shell 110 and/or insert 120 over the second shoulder and behind the back to a point on the torso strap under the first shoulder and generally diametrically opposite to the first end of the second shoulder strap.

Figure 17:
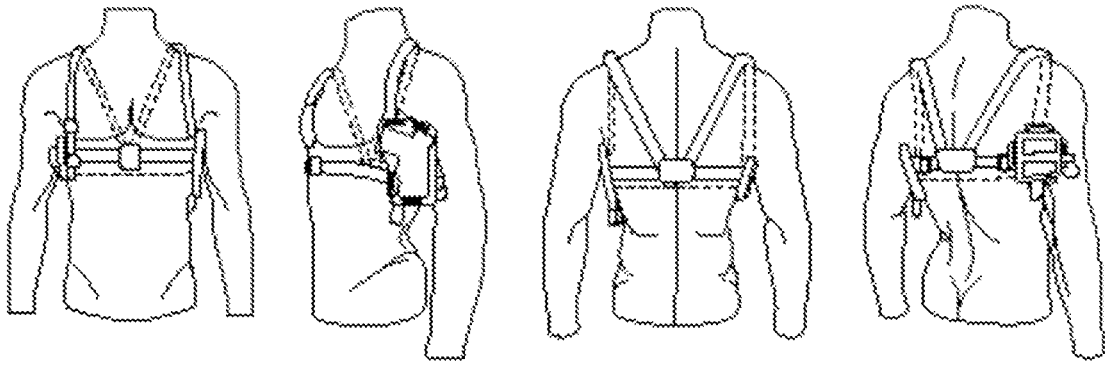
FIG. 17 illustrates yet another example wearable configuration of disclosed concealing holsters.

FIG. 17 yet another example wearable configuration of disclosed concealing holsters. A first strap coupled with the holster shell 110 and holster insert 120, for example, through eyelets 122 and 123, encircles a user's torso. A first shoulder strap loops from a first end coupled to the holster shell 110 and/or insert 120 over a first shoulder and behind the back to its second end at a point on the torso strap behind the back and about 90 degrees around the torso strap. A second shoulder strap loops from a first end coupled to the torso strap generally diametrically opposite to the first end of the first shoulder strap over a second shoulder and behind the back to a point on the torso strap behind the back and adjacent to the second end of the first shoulder strap.

Figure 18:
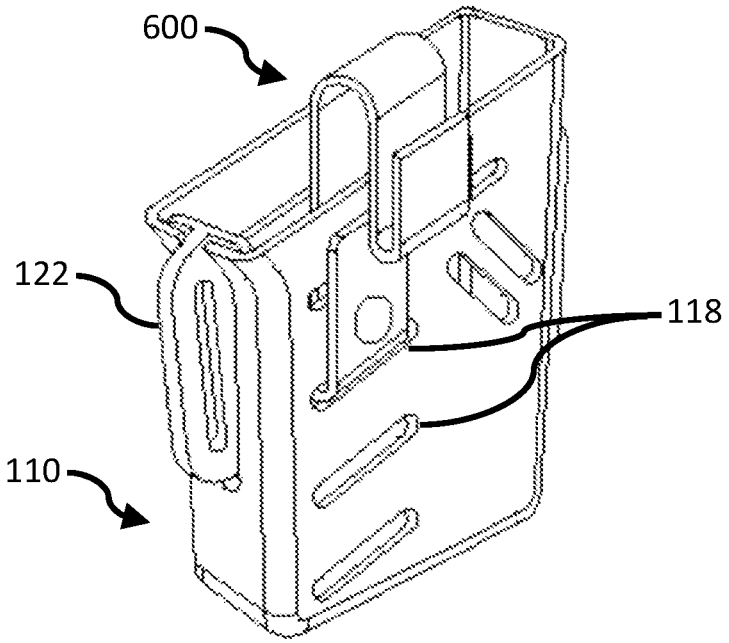
FIG. 18 illustrates a perspective view of an example hook coupled with one or more components of a concealing holster.
Figure 19:
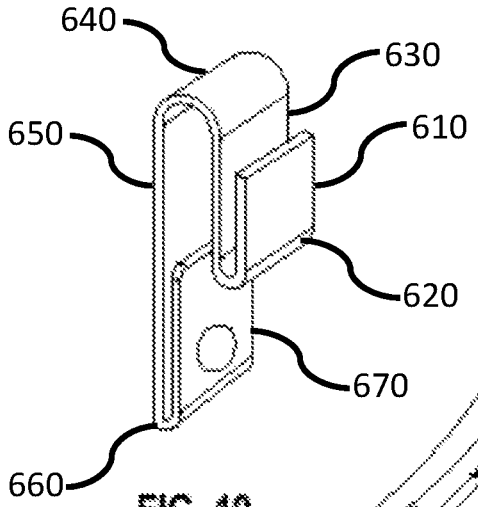
FIG. 19 illustrates a perspective view of an example hook suitable for use in association with disclosed concealing holsters.
Figure 20:
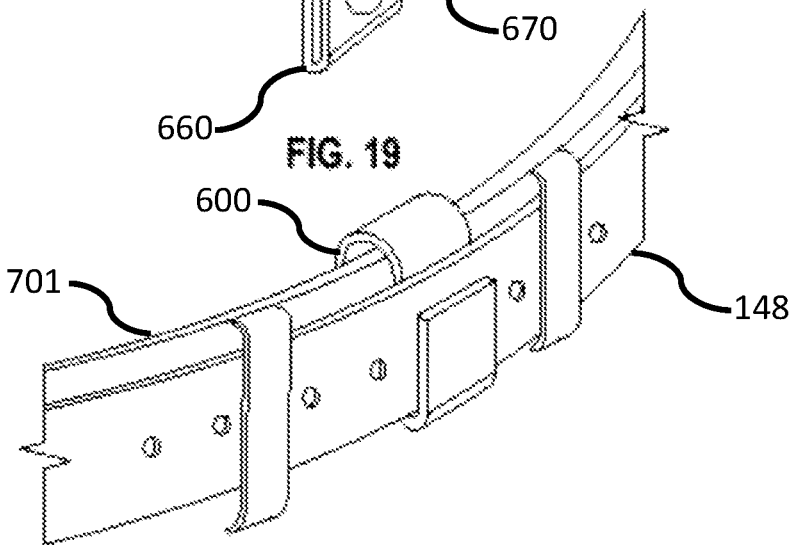
FIG. 20 illustrates a perspective view of the example hook of FIG. 19 coupled with a belt or strap.

Referring to FIGS. 18-20, system 100 may further include an inside-the-waistband hook 600 having three semi-circular curves 620, 640 and 660 between first and second ends dividing the inside-the-waistband hook into first length 610, second length 630, third length 650 and fourth length 670. The fourth length 670 and the third semi-circular curve 660 are configured for receipt through at least one of the pass throughs 118 and 128 of the holster shell 110 and insert 120.

The first semi-circular curve 620 of the inside-the-waistband hook separates the first length 610 from the second length 630. The second semi-circular curve 640 separates the second length 630 from the third length 650. The third semi-circular curve 660 separates the third length 650 from the fourth length 670. The fourth length 670 extends generally between the second length 630 and the third length 650.

The first semi-circular curve of inside-the-waistband hook 600 is configured to receive a belt or strap of a user with first 610 and second 630 lengths flanking opposite sides of the belt or torso strap 148. In this situation, third length 650, third semi-circular curve 660 and fourth length 670 are positioned inside a waistband of a user's clothing with the third semi-circular curve 660 and fourth length 670 at least partially supporting holster shell 110 and holster insert 120 through pass-throughs 118 and 128.

The system 100 may further include a magazine holder including a plurality of pass-throughs configured for receiving the one or more straps.

A method for supporting an article in a concealed state includes inserting a holster insert into a holster shell until a boss engages with a through-hole to removably couple the holster insert to the holster shell. A topper may be coupled with the holster insert and/or the holster shell to close the top end of the holster cavity. At least a first translucent to transparent strap is provided with a first end, a second end and sinusoidal edges therebetween. The first end of the first strap is threaded through one of eyelets and the first end may be folded back onto itself and coupled by insertion of fasteners into perforations of the two lengths of the first strap. With the holster shell and insert coupled to one end of the first strap, the strap may be wrapped around a user's torso and the second end of the first strap is threaded through the other of eyelets to form a loop. At this stage an article may be held in the holster cavity and enclosed by a lid or cap. Alternatively, the article may be provided to the holster cavity prior to threading of the first strap through either of eyelets. The assembled system may be rotated relative to the user's body to position the carried article in a discrete location such as under the armpit.

The method may further include placing a first shoulder strap over a first shoulder of the user, coupling a first end of the first shoulder strap with the torso strap and coupling a second end of the first shoulder strap with the torso strap opposite the first end. The first shoulder strap may be coupled with the torso strap by insertion of fasteners into respective perforations of the first shoulder strap and the torso strap to pin the first and second ends of the first shoulder strap to the torso strap. A first connection to the torso strap would then be positioned outside of a first latissimus dorsi muscle while the second connection would then be positioned outside of the breast on the same side of the torso. A single shoulder strap may be sufficient or a user may prefer to use two shoulder straps.

The method may further include placing a second shoulder strap across a second shoulder of the user, coupling a first end of the second shoulder strap with the torso strap and coupling a second end of the second shoulder strap with the torso strap. The second shoulder strap may be coupled with the torso strap by insertion of fasteners into respective perforations of the second shoulder strap and the torso strap to pin the first and second ends of the second shoulder strap to the torso strap. Similarly to the first shoulder strap, a first connection to the torso strap by the second shoulder strap would then be positioned outside of a first latissimus dorsi muscle while the second connection would then be positioned outside of the breast on the same side of the torso.

Two shoulder straps provide additional weight-bearing capability for those who either carry larger/heavier articles, those who simply prefer to have two straps, or those who prefer to carry an article while jogging or some other physical activity.

In an alternative to the first and second shoulder straps, the method may further include placing a yoke strap across shoulders of the user, coupling a first end of the yoke strap with a torso strap and coupling a second end of the yoke strap with the torso strap generally diametrically opposite to the first end of the yoke strap. The first and second ends of the yoke strap may be coupled to the torso strap by insertion of fasteners into respective perforations of the yoke strap and the torso strap to pin the yoke strap to the torso strap. A first connection to the torso strap would then be positioned immediately below the chest while the second connection to the torso strap would then be positioned substantially at the mid-point of the user's spine.

The actions described above with regard to the method for supporting an article are only illustrative and other alternatives can also be provided where one or more actions are added, one or more actions are removed, or one or more actions are provided in a different sequence without departing from the scope of the claims herein.

Embodiments of the disclosure are susceptible to being used for various purposes, including, though not limited to, enabling users to conceal articles such as firearms or other weapons on their person. Disclosed systems may be offered as a complete kit or may be offered as individual components. For example, a system may be sold with a holster shell, a holster insert, a cap, several straps and fasteners while a lid, concealing cloaks and concealing sleeves are offered separately as modifications.

Disclosed systems significantly reduce imprinting (patterning through clothing) by substantially eliminating consistent visible line patterns imparted on clothing's fabric and reduce visible shadows otherwise created by known systems. The softness (low durometer) of the material, combined with positioning of the straps on the body, and further, the location of the article being carried also contribute to improved concealment. Straps may be located behind natural clothing seams, for example, behind the buttons on a button-down shirt, in alignment with the "V" on a V-neck tee shirt, or immediately under the chest behind a natural void created by the fabric overhanging the chest. An article may be positioned under either armpit where there is typically extra fabric than in other places of clothing.

Disclosed systems substantially or practically eliminate pinch points or similar characteristics that create painful or uncomfortable use. Further, the finish on the material of construction may be comparable to smooth glass in order to reduce/eliminate friction between the material and clothing as well as between the material and skin and/or body hair of the user. Disclosed systems reduce any pull on clothing fabric in a way that reveals something held under the fabric. Stretching and/or pulling of clothing will be reduced and body distortions will be substantially eliminated.

Modifications to embodiments of the disclosure described in the foregoing are possible without departing from the scope of the disclosure as defined by the accompanying claims. Expressions such as "including", "comprising", "incorporating", "consisting of", "have", "is" used to describe and claim disclosed features are intended to be construed in a non-exclusive manner, namely allowing for items, components or elements not explicitly described also to be present. Reference to the singular is also to be construed to relate to the plural.

What is claimed is:

1. A system for supporting an article in a concealed state, comprising:

a holster shell surrounding a holster cavity bounded in part by an upper perimeter having at least first and second opposing edges and defining first and second slots opening the holster cavity to surroundings;

a holster insert configured for receipt within the holster cavity and including at least first and second opposing eyelets configured for engaging the first and second slots of the holster shell; and having a visible light transmittance of at least 10%, a first perforated strap having first and second ends configured for threading through the opposing eyelets of the holster insert.

2. The system as set forth in claim 1, wherein first strap further comprises beveled edges.

3. The system as set forth in claim 1, wherein first strap further comprises rounded edges.

4. The system as set forth in claim 1, wherein the perforations of the first strap further comprise beveled edges.

5. The system as set forth in claim 1, wherein the perforations of the first strap further comprise rounded edges.

6. The system as set forth in claim 1, further comprising a topper configured for coupling with the holster shell and/or the holster insert so as to extend away from the upper perimeter of the holster cavity in a direction opposite the first and second slots and to close the holster cavity at the upper perimeter.

7. The system as set forth in claim 6, wherein the topper further comprises a cap including:

at least one retention loop configured to surround and grip at least one of the opposing eyelets of the holster insert; and in a top of the cap distal from the plurality of retention loops, a split configured for flexing between a closed position for retaining an article within the holster insert and an open position for releasing an article within the holster insert.

8. The system as set forth in claim 6, further comprising a plurality of interchangeable concealing cloaks each matching a silhouette of an assembly of the holster shell, holster insert and topper and reflecting one of a plurality of skin tone colors with which a user's skin tone may be matched.

9. The system as set forth in claim 1, further comprising a plurality of interchangeable concealing sleeves each configured for receipt between an interior surface of the holster cavity and an exterior surface of the holster insert and reflecting one of a plurality of skin tone colors with which a user's skin tone may be matched.

10. A system for supporting an article in a concealed state, comprising:

a holster shell surrounding a holster cavity bounded in part by an upper perimeter having at least first and second opposing edges and defining first and second slots opening the holster cavity to surroundings;

a holster insert configured for receipt within the holster cavity and including at least first and second opposing eyelets configured for engaging the first and second slots of the holster shell; and a first perforated strap having first and second ends configured for threading through the opposing eyelets of the holster insert and, extending between the first and second ends, first and second long edges which follow wave-like paths.

11. The system as set forth in claim 10, wherein first strap further comprises beveled edges.

12. The system as set forth in claim 10, wherein first strap further comprises rounded edges.

13. The system as set forth in claim 10, wherein the perforations of the first strap further comprise beveled edges.

14. The system as set forth in claim 10, wherein the perforations of the first strap further comprise rounded edges.

15. The system as set forth in claim 10, further comprising a topper configured for coupling with the holster shell and/or the holster insert so as to extend away from the upper perimeter of the holster cavity in a direction opposite the first and second slots and to close the holster cavity at the upper perimeter.

16. The system as set forth in claim 15, wherein the topper further comprises a cap including at least one retention loop configured to surround and grip at least one of the opposing eyelets of the holster insert and, in a top of the cap distal from the at least one retention loop, a split configured for flexing between a closed position for retaining an article within the holster insert and an open position for releasing an article within the holster insert.

17. The system as set forth in claim 15, further comprising a plurality of interchangeable concealing cloaks each matching a silhouette of an assembly of the holster shell, holster insert and topper and reflecting one of a plurality of skin tone colors with which a user's skin tone may be matched.

18. The system as set forth in claim 10, further comprising a plurality of concealing sleeves each configured for receipt between an interior surface of the holster cavity and an exterior surface of the holster insert, and reflecting one of a plurality of skin tone colors with which a user's skin tone may be matched.

19. A system for supporting an article in a concealed state, comprising:

a holster shell including a holster cavity bounded in part by an upper perimeter and having an internal positive retention feature distal from the upper perimeter;

a holster insert configured for receipt within the holster cavity and including a through-hole configured for engagement with the positive retention feature to selectively lock the holster insert within the holster cavity; and a cap configured to surround the holster cavity adjacent to the upper perimeter and including in a top, of the cap, a split configured for flexing between a closed position retaining an article within the holster insert and an open position releasing an article within the holster insert.

20. The system as set forth in claim 19, further comprising a plurality of perforated straps each having an opacity from translucent to transparent and including:

first and second ends configured for selective coupling with the holster shell and/or the holster insert; and extending between the first and second ends, first and second long edges which follow sinusoidal paths.

* * * * *